US006324970B1

(12) United States Patent
Mori

(10) Patent No.: US 6,324,970 B1
(45) Date of Patent: Dec. 4, 2001

(54) DEVICE FOR PRESSING A CERAMIC STACKED LAYER STRUCTURE

(75) Inventor: Haruhiko Mori, Takefu (JP)

(73) Assignee: Murata Manufacturing Co., Ltd., Nagaokakyo (JP)

( * ) Notice: Subject to any disclaimer, the term of this patent is extended or adjusted under 35 U.S.C. 154(b) by 0 days.

(21) Appl. No.: 09/193,838

(22) Filed: Nov. 18, 1998

(30) Foreign Application Priority Data

Nov. 20, 1997 (JP) ..... 9-337742

(51) Int. Cl.[7] ..... B30B 7/04
(52) U.S. Cl. ..... 100/232; 100/242
(58) Field of Search ..... 100/232, 242

(56) References Cited

U.S. PATENT DOCUMENTS

| | | | | |
|---|---|---|---|---|
| 529,254 | * | 11/1894 | Fink | 100/232 |
| 2,867,002 | * | 1/1959 | Zalozecky | 100/232 |
| 2,880,668 | * | 4/1959 | Cranke | 100/232 |
| 3,727,545 | * | 4/1973 | Madsen et al. | 100/232 |
| 4,826,419 | * | 5/1989 | Coste et al. | 100/232 |
| 4,990,081 | * | 2/1991 | VanVoren et al. | 100/232 |
| 5,807,455 | * | 9/1998 | Giordano et al. . | |

FOREIGN PATENT DOCUMENTS

| | | |
|---|---|---|
| 2 227 713 | 8/1990 | (GB) . |
| 6-091627 | 4/1994 | (JP) . |
| 6-190815 | 7/1994 | (JP) . |
| 6-297432 | 10/1994 | (JP) . |

* cited by examiner

*Primary Examiner*—Stephen F. Gerrity
(74) *Attorney, Agent, or Firm*—Burns, Doane, Swecker & Mathis, LLP

(57) ABSTRACT

A pressing device and a pressing method, wherein the method includes the steps of accommodating a stacked layer structure in a recess in a die body, and pressing the stacked layer structure in the recess of the die body between a bottom plate of the die body that forms a bottom wall of the recess and a top die, while laterally supporting sides or side walls of the die body that form side walls of the recess. The pressing device includes a die body which is small, light, and easy to handle, and also includes thrust mechanisms for laterally positioning the die body. The thrust mechanisms also laterally support the side walls of the die body when a stacked layer structure in the recess of the die body is pressed between the bottom plate of the die body and a top die. The pressing method makes it possible to press a ceramic stacked layer structure efficiently using the small and light die body.

13 Claims, 5 Drawing Sheets

DEVICE FOR PRESSING A CERAMIC STACKED LAYER STRUCTURE

This application corresponds to Japanese Application No. 9-337742, filed on Nov. 20, 1997, which is hereby incorporated by reference in its entirety.

BACKGROUND

1. Field of the Invention

The present invention relates to a pressing device and a pressing method, and, more particularly, to a pressing device for pressing a ceramic stacked layer structure including ceramic green sheets placed upon each other, and to a method of pressing a ceramic stacked layer structure using the pressing device.

2. Description of the Related Art

A typical example of a laminated ceramic electronic part is a monolithic ceramic capacitor. In a typical structure of the monolithic ceramic capacitor, external electrodes are disposed on ceramic elements. The ceramic elements are made from ceramic dielectric material, and have internal electrodes formed thereon. These internal electrodes are electrically connected to the external electrodes.

Monolithic ceramic capacitors are ordinarily produced in the following way. Ceramic green sheets, with internal electrode patterns formed thereon, are placed in a stacked layer structure and pressed together. The resulting pressed structure is then cut at predetermined locations to form individual ceramic elements. Afterwards, external electrodes are disposed on each of the individual ceramic elements.

Ordinarily, the ceramic stacked layer structure consisting of ceramic green sheets placed upon each other is pressed in order to squeeze the ceramic green sheets together, as shown in FIG. 5. The ceramic stacked layer structure 51 is set in a die body 52 and a top die 53, and is then pressed or squeezed between the die body 52 and the top die 53.

In order to press the stacked layer structure 51 and thereby squeeze the ceramic green sheets together, it is necessary to exert a high pressure on the stacked layer structure 51. This means that the die body 52 must be able to withstand high pressures. Therefore, the die body 52 is ordinarily large and heavy. However, a large and heavy die body 52 cannot be easily handled in the pressing operation. As a result, the pressing operation cannot be easily performed.

Since the die body 52 is heavy, a light-weight container, or jig, must be separately provided for transporting the stacked layer structure 51 to a location where the pressing operation is performed. This means that an additional step must be performed to transfer the ceramic stacked layer structure from the separately provided container to the die body 52 of the pressing device. This transfer is troublesome to perform, and can also cause the ceramic green sheets of the ceramic structure to become misaligned, thereby degrading desirable properties of the monolithic ceramic capacitor.

SUMMARY

Accordingly, it is an object of the present invention to provide a pressing device for pressing a ceramic stacked layer structure, that is small and light and includes an easily handleable die body, and a corresponding method of efficiently pressing the ceramic stacked layer structure.

In accordance with an embodiment of the present invention, a pressing device for pressing a ceramic stacked layer structure includes a die body having a bottom portion or bottom plate and a side wall portion that form a recess.

The recess can accommodate a ceramic stacked layer structure of ceramic green sheets placed upon each other. One or more mechanisms for holding and pushing or exerting force on the die are also provided, and each includes a contact member and a thrusting mechanism. The contact member contacts an outer peripheral surface of the side wall portion of the die body. The thrusting mechanism pushes the contact member against the side wall portion of the die body in a direction toward an inner peripheral surface side of the side wall portion, i.e., toward the recess, to thereby position and reinforce the die body. A top die is also provided for pressing the stacked layer structure against the bottom plate of the die body when the stacked layer structure is accommodated in the recess of the die body.

Since the contact members and the thrusting mechanisms support the side wall portions of the die body during the pressing operation and help the die body withstand the high pressures of the pressing operation, the required strength of the die body is less than that of a conventional die mold which must withstand the high pressures of the pressing operation alone without support. Therefore, the die body can be made small and light.

In an embodiment of the invention, the bottom portion and the side wall portion of the die body can be separated from each other. Consequently, the die body can be constructed with a greater degree of freedom, and handled more easily. Alternatively, the bottom portion and the side wall portion of the die body can be integral parts of the same component.

Since the die body can be made small and light, it can be conveniently used as a container for transferring a stacked layer structure. Therefore, it is no longer necessary to provide a separate container for transporting the stacked layer structure, and then transfer the stacked layer structure from the separately provided container to the die body. This simplifies the pressing operation and eliminates problems caused by misalignment of the ceramic green sheets that occurs when the stacked layer structure is transferred from the separately provided container. For instance, the above-described apparatus reduces damage caused to the stacked layer structure compared to the conventional die apparatus.

According to another aspect of the present invention, a method of pressing a stacked layer structure consisting of ceramic green sheets placed upon each other includes the steps of accommodating the stacked layer structure in the recess of the die body, and pressing the stacked layer structure in the recess of the die body between a bottom plate of the die body and the top die, while supporting the side wall portions of the die body and positioning the die body by pressing the side wall portions inward toward the stacked layer structure using the contact members and the thrust mechanisms.

BRIEF DESCRIPTION OF THE DRAWINGS

Other objects and advantages of the invention will become apparent to those skilled in the art from the following detailed description of preferred embodiments, when read in conjunction with the accompanying drawings. Like elements in the drawings have been designated with like reference numerals.

DESCRIPTION OF THE PREFERRED EMBODIMENTS

Figure 1:
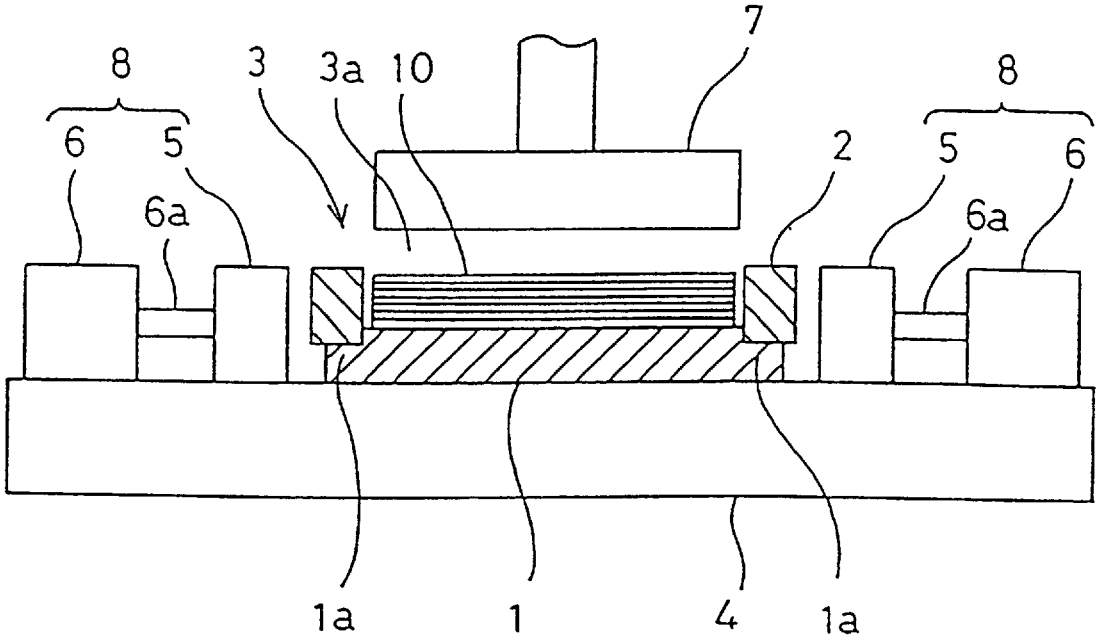
FIG. 1 is a side view of a device for pressing a ceramic stacked layer structure in accordance with an embodiment of the present invention.

As shown in FIG. 1, a pressing device in accordance with an embodiment of the invention includes a die body 3 with a bottom plate 1 and side wall portions 2. The bottom plate 1 and the side wall portions 2 form a recess 3*a* in the die body 3. The recess 3*a* can accommodate a ceramic stacked layer structure 10, which consists of ceramic green sheets placed upon each other.

The pressing device also includes a die base 4 onto which the die body 3 is placed. Contact members 5 can be moved to contact outer peripheral surfaces of the side wall portions 2 of the die body 3, and thereby position and hold the die body 3 at a predetermined location. Thrust mechanisms 6 each having a thrust member 6a (e.g., comprising a rod or like structure) are provided to actuate and press the contact members 5 against the outer peripheral surfaces of the side wall portions 2, towards inner peripheral surfaces of the side wall portions 2. The thrust mechanisms 6 can be, for example, piston and cylinder type mechanisms. Those skilled in the art will recognize that the thrust mechanisms 6 can be implemented in different ways. For example, the thrust mechanisms 6 can have a cotter type mechanism for applying force to the contact members 5.

A top die 7 having a shape corresponding to the recess 3*a* formed in the die body 3 can be used to press the stacked layer structure 10 between the top die 7 and the bottom plate 1. The contact members 5 and the thrust mechanisms 6 together form a die positioner 8. Each contact member 5 can be formed so that it comes into contact with virtually the entire outer peripheral surface of an adjacent side wall portion 2, and is connected to a corresponding thrust member 6*a*. The thrust mechanisms 6 can be attached or secured to the die base 4.

The peripheral portion of the bottom plate 1 of the die body 3 can be thin, and can be provided with steps 1*a*. When the side wall portions 2 are fitted to the respective steps 1*a,* the bottom portion 1 and the side wall portions 2 are separably engaged to form the recess 3*a*. The contact surfaces between the bottom plate 1 and the side wall portions 2 can alternatively be provided with a different contour than the steps 1*a,* for example a tongue and groove arrangement.

The die body 3 can be used as a container or jig for transferring the stacked layer structure 10, and can be placed onto and separated from the die base 4.

In the exemplary embodiment shown in the figures, there are four side walls, four contact members and four thrust mechanisms, although other arrangements can be used.

A description will now be given of the method of pressing the stacked layer structure 10, using the above-described pressing device.

After a ceramic stacked layer structure has been formed by placing a plurality of ceramic green sheets upon each other in the recess 3*a* of the die body 3, the die body 3 can be transported with the layer structure 10 in the recess 3*a* to a location where the pressing operation is performed, and placed onto the die base 4. Thus, the die body 3 can be used as a transport container for the layer structure 10.

Figure 2:
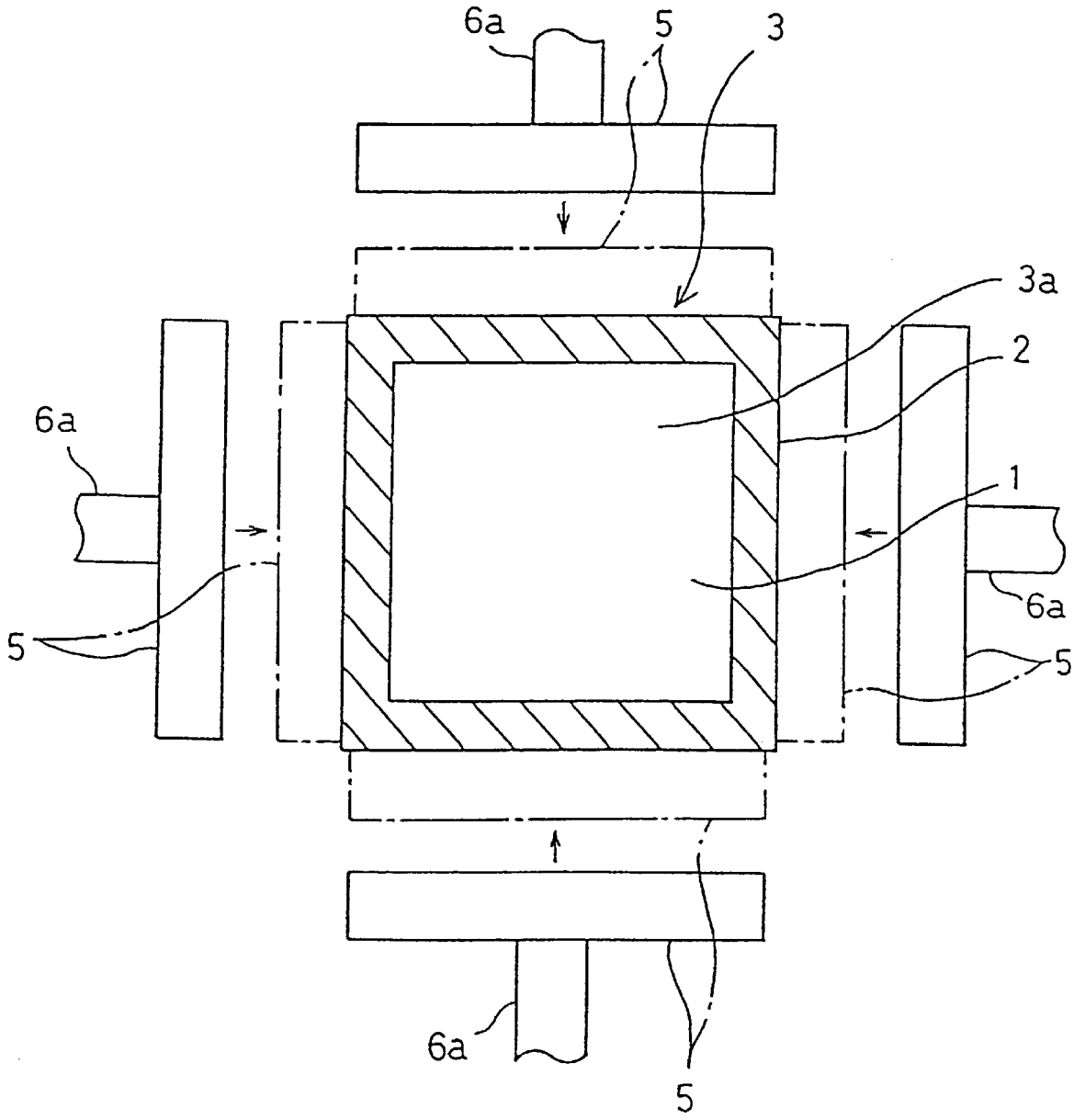
FIG. 2 is a top view of the device of FIG. 1.
Figure 3:
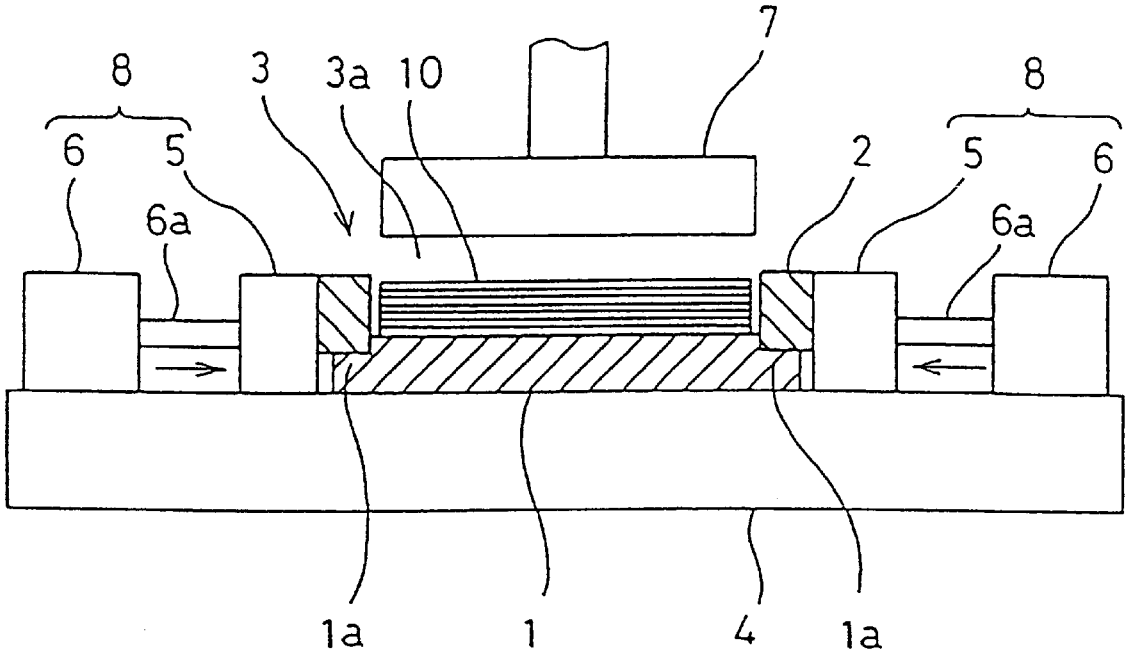
FIG. 3 illustrates a function of the device of FIG. 1.

As shown in FIG. 2, after the die body 3 has been placed onto the die base 4, the contact members 5 can be actuated to press against outer faces or peripheral surfaces of the sidewalls 2, inward toward the recess 3*a*. This is also shown in FIG. 3, where each contact member 5 is pushed by its associated thrust mechanism 6 until it comes into contact with the outer peripheral surface of an adjacent side wall portion 2 of the die body 3. In this way, the thrust mechanisms 6 and the contact members 5 can move the die body 3 on the die base 4 until the die body 3 is properly located, and then hold the die body 3 at the proper location. The proper location can be predetermined. For example, the proper location can be directly beneath the top die 7.

Figure 4:
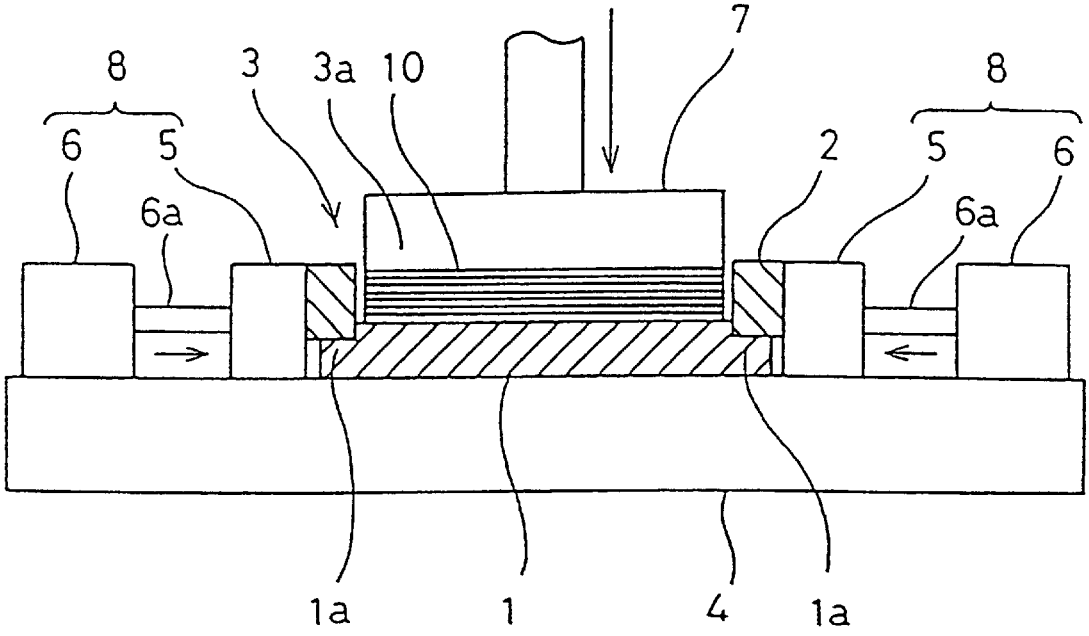
FIG. 4 illustrates a function of the device of FIG. 1.

As shown in FIG. 4, the thrust mechanisms 6 can continue to push the respective contact members 5 against the respective side wall portions 2 of the die body 3 with a predetermined pressure, to support the side wall portions 2 and hold the die body 3 at the proper location as the top die 7 moves downward and presses the stacked layer structure 10 between the top die 7 and the bottom plate 1.

Figure 5:
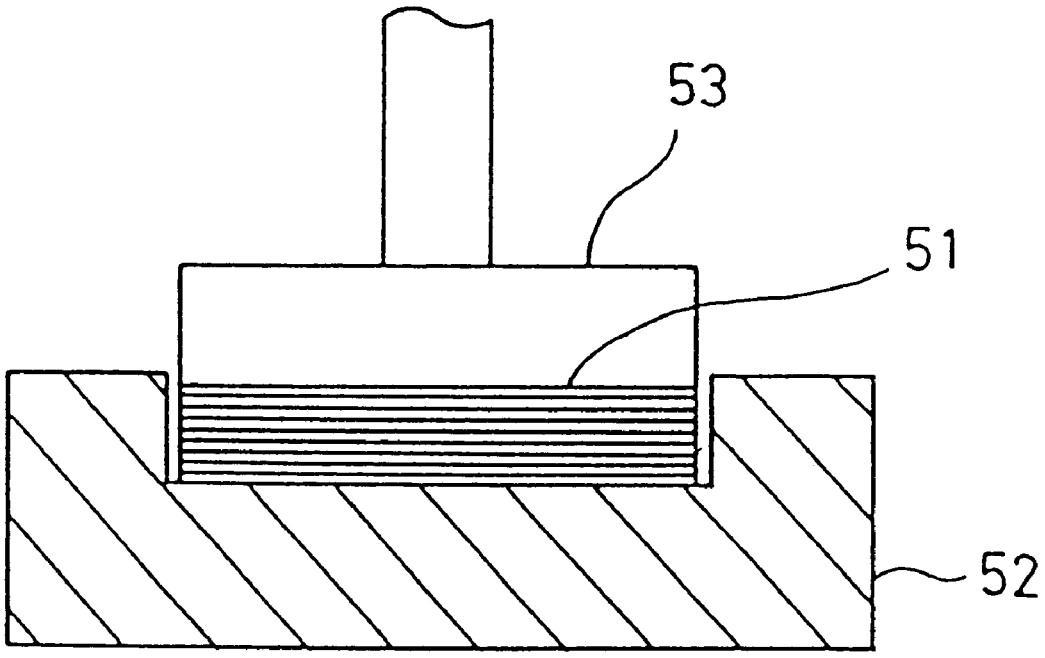
FIG. 5 (PRIOR ART)
FIG. 5 illustrates a conventional pressing device for pressing a ceramic stacked layer structure.

Since each contact member 5 presses against the outer peripheral surface of an adjacent side wall portion 2 of the die body 3 and thereby positions and reinforces the die body 3 while the stacked layer structure 10 is pressed between the top die 7 and the bottom plate 1, the required strength of the die body 3 is less than that of the conventional die mold shown in FIG. 5. This is because the conventional die mold must be strong enough to withstand the high pressure alone without reinforcement. In other words, since the contact members 5 press against and support each side wall portion 2 of the die body 3 and thereby strengthen the die body 3 while the stacked layer structure 10 is being pressed between the top die 7 and the bottom plate 1, the die body 3 can be made small and light. This risk of breakage of the side wall portions 2 is also reduced.

Since the die body 3 is small and light, it can be used as a container or jig to easily transfer or transport the stacked layer structure 10. Therefore, it is not necessary to transfer the stacked layer structure from a separately provided transport container to the die body. This greatly simplifies the pressing operation and eliminates problems that result from misalignment of the ceramic green sheets of the stacked layer structure that occurs when the ceramic stacked layer structure is being transferred from the separately provided container to the die body. For instance, the above-described apparatus reduces the risk of damage caused to the stacked layer structure.

Since the bottom plate 1 and the side wall portions 2 of the die body 3 are provided so as to be separable from each other, the die body 3 can be more easily constructed and handled.

In the present embodiment, the bottom portion 1 and the side wall portions 2 of the die body 3 are provided so as to be separable from each other. Alternatively, they can be integrally formed.

It will be appreciated by those skilled in the art that the present invention can be embodied in other specific forms without departing from the spirit or essential characteristics thereof, and that the invention is not limited to the specific embodiments described herein. For example, various modifications can be made within the scope of the invention with respect to the specific shape of the die body, the pressure during the pressing operation, the pressing time, and so forth. The presently disclosed embodiments are therefore considered in all respects to be illustrative and not restrictive. The scope of the invention is indicated by the appended claims rather than the foregoing description, and all changes that come within the meaning and range and equivalents thereof are intended to be embraced therein.

What is claimed is:

1. A device for pressing a ceramic stacked layer structure, comprising:

a die body having a bottom plate and at least one side wall, the bottom plate and the at least one side wall forming a recess for receiving a ceramic stacked layer structure;

at least one thrust mechanism for applying force to the at least one side wall in a direction toward the recess; and a top die for pressing the ceramic stacked layer structure between the top die and the bottom plate of the die body;

wherein the bottom plate includes a step formed at its periphery, and said at least one side wall is fitted to said step.

2. The device of claim 1, wherein the bottom plate and the at least one side wall are discrete components.

3. The device of claim 1, wherein the bottom plate and the at least one side wall are separable.

4. The device of claim 1, wherein the at least one side wall is integral with the bottom plate.

5. The device of claim 1, further comprising:

a ceramic layered structure including a plurality of ceramic green sheets located adjacent one to another, said ceramic layered structure positioned in said die body recess.

6. The device of claim 1, further comprising a die base which supports the bottom plate of the die body, and to which the at least one thrust mechanism is attached.

7. The device of claim 1, further including at least one contact member which comes into contact with said at least one side wall, said at least one thrust mechanism applying force to said at least one side wall via said at least one contact member.

8. The device of claim 7, wherein said at least one thrust mechanism includes a thrust member, wherein one end of said thrust member is connected to said at least one contact member.

9. The device of claim 1, wherein said at least one thrust mechanism includes a piston and cylinder.

10. The device of claim 1, comprising four side walls which together form a frame.

11. The device of claim 10, wherein said at least one thrust mechanism comprises four thrust mechanisms for applying force against said four side walls, respectively.

12. The device of claim 11, further comprising four contact members which come into contact with said four side walls, respectively, said four thrust mechanisms applying force to said respective four side walls via said respective four contact members.

13. The device of claim 1, wherein said top die is sized and configured to fit in said recess.

* * * * *